United States Patent [19]

Barto et al.

[11] 4,027,499

[45] June 7, 1977

[54] REFRIGERATOR WATER RESERVOIR ASSEMBLY FOR AUTOMATICALLY SUPPLYING WATER TO THE ICE MAKER FROM THE RESERVOIR

[76] Inventors: Robert W. Barto, 2019 Duval Lane, Hayward, Calif. 94545; Leonard A. Brown, 20045 Elfin Forrest Road, Escondido, Calif. 92025

[22] Filed: Apr. 12, 1976

[21] Appl. No.: 675,919

[52] U.S. Cl. ..... 62/340; 62/188; 62/231

[51] Int. Cl.[2] ..... F25C 1/00

[58] Field of Search ..... 62/340, 188, 389, 337, 62/231

[56] References Cited

UNITED STATES PATENTS

| | | | |
|---|---|---|---|
| 2,846,854 | 8/1958 | Galin | 62/337 X |
| 3,429,140 | 2/1969 | White | 62/390 X |
| 3,583,437 | 6/1971 | Mastroianni | 222/56 X |
| 3,750,420 | 8/1973 | Webb | 62/353 X |
| 3,826,102 | 7/1974 | Horvay et al. | 62/188 X |

*Primary Examiner*—William E. Wayner
*Assistant Examiner*—William E. Tapolcai, Jr.
*Attorney, Agent, or Firm*—William R. Piper

[57] ABSTRACT

A water reservoir for a refrigerator that has an automatic ice maker and novel means for delivering water from the reservoir to the ice maker as needed thereby doing away with the necessity of connecting the refrigerator to the city water supply. No alterations are necessary to be made in a standard refrigerator that is already equipped with the automatic ice maker. The novel means for delivering water from the reservoir to the ice maker includes an electric motor driven pump that is automatically connected to a source of electric currents as soon as a sequential cam in the ice maker closes a switch. The novel means also includes a manually controlled switch that will cause the motor and pump to refill the reservoir from a water source when needed.

3 Claims, 9 Drawing Figures

AUTO
REFILL
4
2
2
3
F
E
N
28
14
B
43
42
C
48
8
M
E
3
F
G
38
37
8
42
20
15
46
7
7
21
J
L
34
26
24
25
H
3
3

FIG-6-
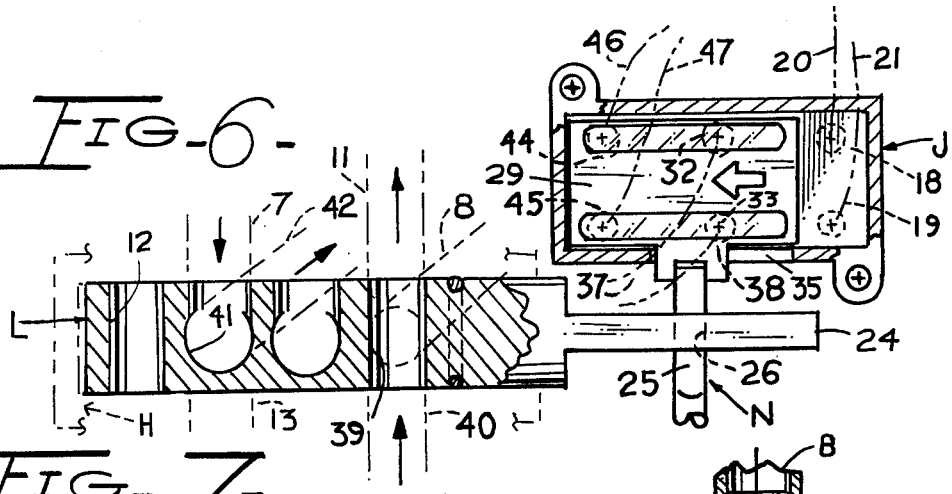
FIG-7-
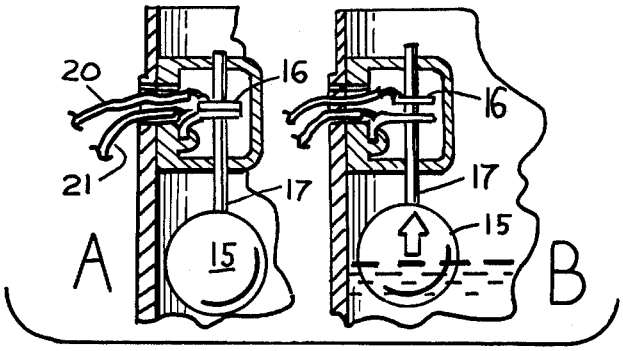
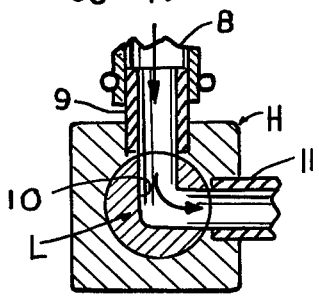
FIG-8-
FIG-9-
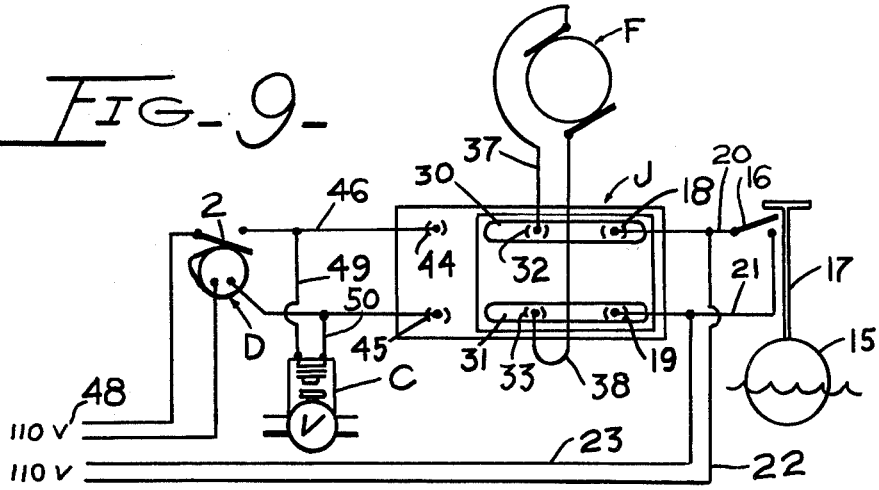

REFRIGERATOR WATER RESERVOIR ASSEMBLY FOR AUTOMATICALLY SUPPLYING WATER TO THE ICE MAKER FROM THE RESERVOIR

SUMMARY OF THE INVENTION

An object of our invention is to save the installation charge made by a plumber who would normally have to connect the city water supply line to the part of the standard refrigerator that supplies water to the automatic ice maker. Our present invention differs from our co-pending patent application on a refrigerator water reservoir assembly for the automatic ice maker and the ice water dispenser, Ser. No. 540,533, filed Jan. 13, 1975, now Pat. No. 3,969,909. In that application the electric motor and pump were automatically started by a water pressure sensitive switch which was closed when the water pressure in the conduit supplying water to the ice maker dropped below a certain point and this occurred each time the ice maker demanded more water. In our present invention the electric circuit to the motor and pump is closed when the sequential cam in the ice maker closes the switch for this electric circuit and the pump will take the water from the reservoir and supply it under the desired pressure to the ice maker.

Another advantage of our invention is that it does away with the necessity of placing the refrigerator near a water pipe that supplies city water. The refrigerator can be placed anywhere desired. Our novel water supplying means to the ice maker not only makes use of a multiple manually operated valve that can be moved from automatic position to refill position, but it also includes a multiple switch for causing the electric motor and pump to be connected to an electric circuit when the sequential cam in the ice maker closes a switch for this circuit while the valve is in automatic position and for causing the motor to be connected to another electric circuit when the valve is moved into refill position for replenishing the water in the reservoir.

BRIEF DESCRIPTION OF THE DRAWINGS

FIG. 6 is a view similar to FIG. 5, but shows both the multiple water control valve body and the multiple electric switch in automatic or normal position which causes water to be delivered from the reservoir to the ice maker as needed.

FIG. 7, view A, is an enlarged vertical section through a portion of the water reservoir and through the float controlled switch, showing the latter in closed position and is taken along line 7—7 of FIG. 2. View B, of FIG. 7 is similar to view A but shows the switch in open position.

FIG.8 is a transverse section through the multiple water control valve housing and valve body and is taken along the line 8—8 of FIG. 5.

FIG. 9 is a schematic wiring diagram of the electric circuits used in our invention.

DESCRIPTION OF THE PREFERRED EMBODIMENT

Figures 1, 2:
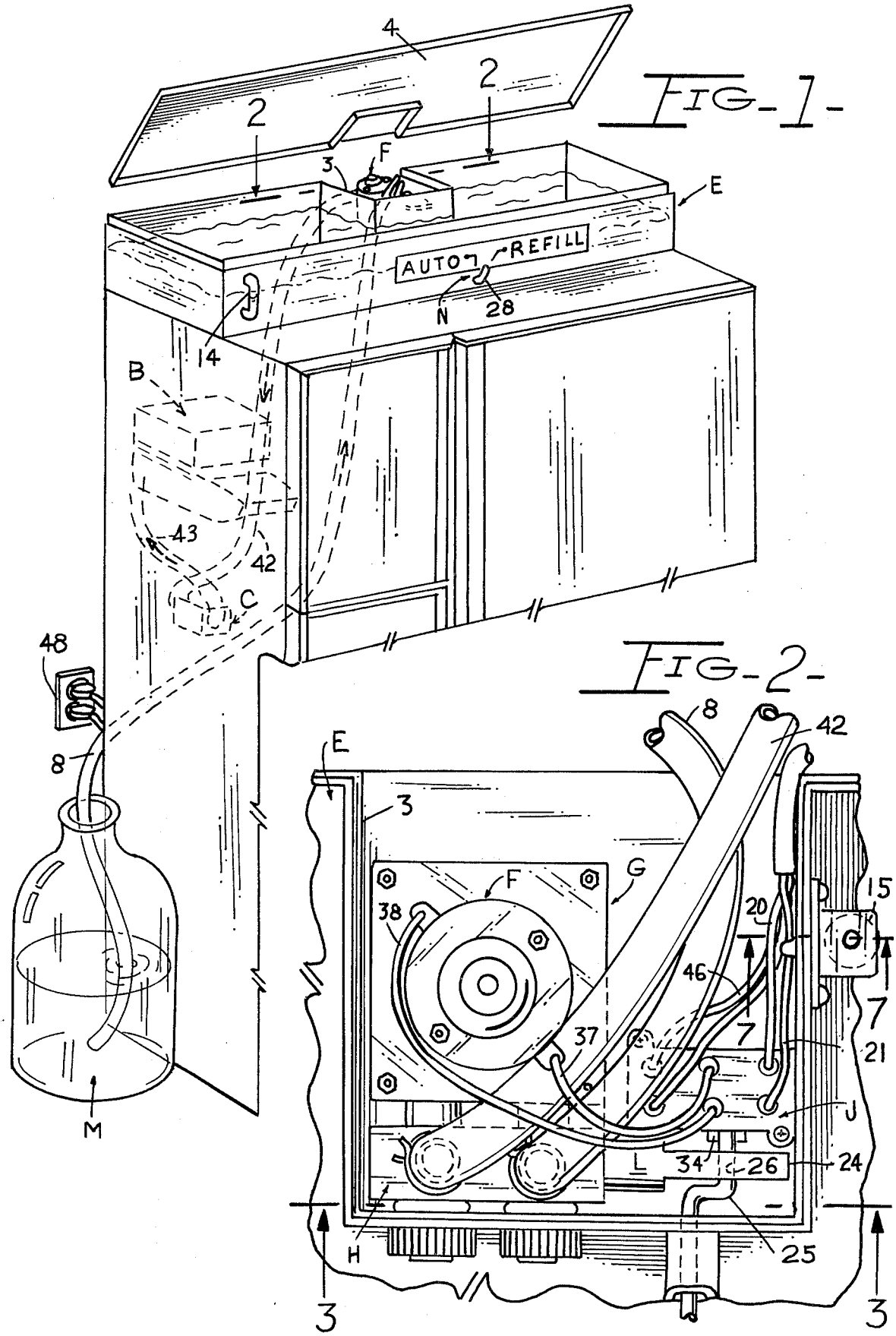
FIG. 1 is an isometric view of a standard refrigerator equipped with an automatic ice maker and illustrates our water reservoir and associate mechanisms for automatically delivering water from the reservoir to the ice maker as needed and for replenishing the reservoir with water.
FIG. 2 is an enlarged top plan view of the motor, the pump, the multiple water control valve and the multiple electric switch when looking in the direction of the arrows 2—2 of FIG. 1.

In carrying out our invention we make use of a standard refrigerator A equipped with an ice maker B, and a solenoid valve c which controls the flow of water through a conduit 43 to the ice maker, see FIG. 1. The ice maker operates a sequence cam D, shown diagrammatically in the wiring diagram of FIG. 9, and when the ice maker needs an additional supply of water for making ice cubes, it is this sequence cam that closes a switch 2 which in turn will close an electric circuit for opening the solenoid valve C, and permit water to flow through the conduit 43 to the ice maker B. We will now describe the mechanisms that will feed water under the proper pressure to the conduit 43 from a water reservoir E when the solenoid valve is opened and thus do away with the necessity of connecting the refrigerator to the city water supply.

Figure 3:
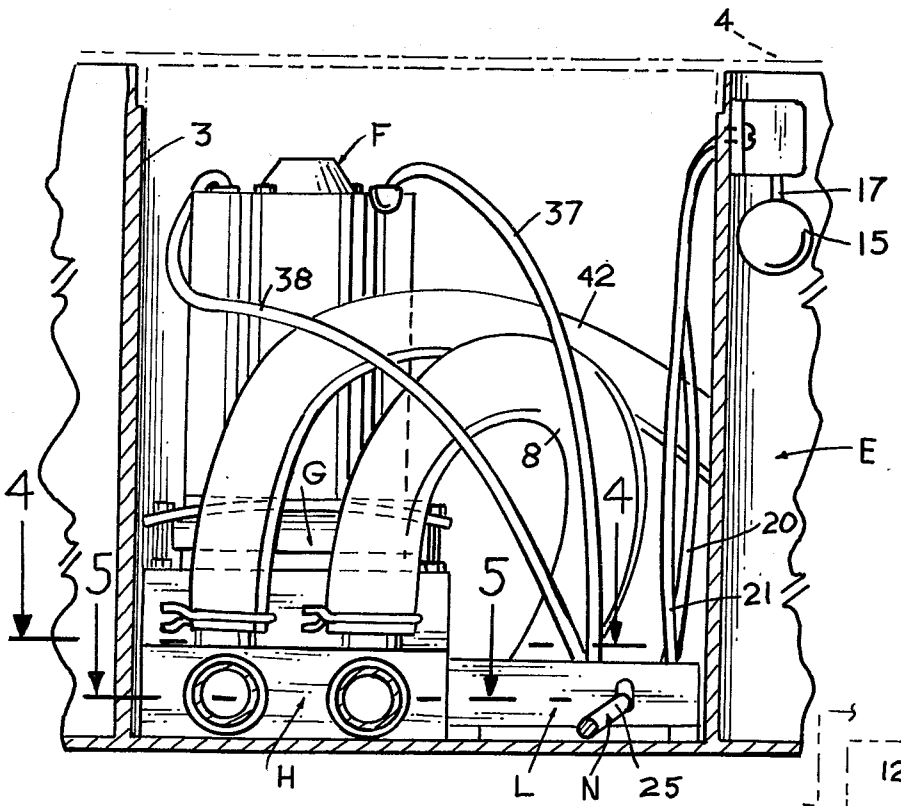
FIG. 3 is a vertical transverse section taken along the line 3—3 of FIG. 2.

FIG. 1 shows the water containing reservoir E placed on top of the refrigerator although it could be placed anywhere that is near to the refrigerator A. At the rear of the reservoir we provide a compartment 3 and in it we mount an electric motor F, a water pump G, a multiple water control valve H, and a multiple electric switch J, see the enlarged top plan view of the compartment 3 in FIG. 2 and the enlarged front elevational view of the motor, the pump and the multiple valve in FIG. 3. A cover 4 for the water reservoir E and the compartment 3 is shown in FIG. 1 as being lifted above the reservoir and in a position to be applied to the top of the reservoir .

Figure 4:
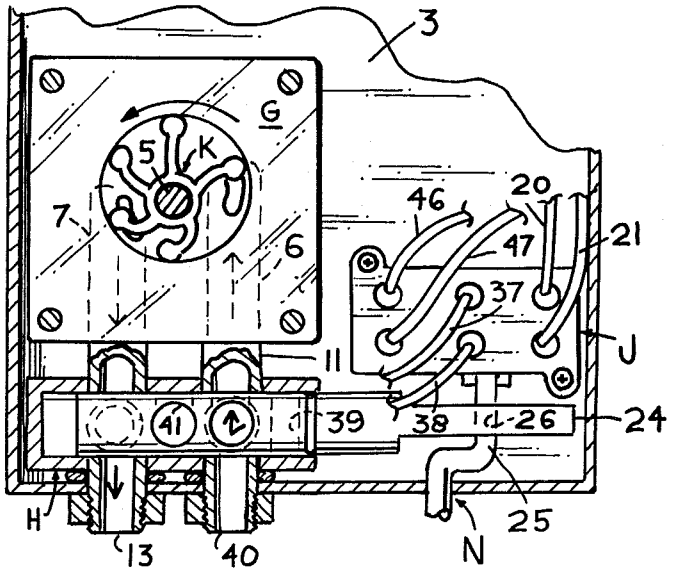
FIG. 4 is a horizontal section through the multiple water control valve and is taken along the line 4—4 of FIG. 3, but shows the valve body in elevation.

The electric motor F, is mounted on top of the water pump G, and the motor shaft may be directly connected to the shaft 5 of the pump impeller K, or there may be a gear reduction train, not shown, between the motor shaft and the impeller shaft 5 for causing the latter to rotate at the desired speed, see FIG. 4. The impeller rotates in a counterclockwise direction and it has a water inlet 6 that connects with the housing of the multiple water valve H, and it also has a water outlet 7 connecting with the same housing. A valve body L, is slidably mounted in the housing H, and it is provided with a plurality of bores which are brought into registration with the inlet 6 and outlet 7 for the water pump G when the valve body is in either one of its two positions.

We will first describe the position of the valve body L, in its position when the operator desires to fill the reservoir E with water from a water source, such as the jug M of water shown in FIG. 1. A water conveying flexible conduit 8 communicates with the water within the auxiliary water supply M, and has its other end connected to a nipple 9, see the enlarged transverse sectional view in FIG. 8, carried by the top of the water valve housing H. The valve body L, is in its "fill cycle" position which means that water is being transferred from the auxiliary water supply M to the water holding reservoir E. The valve body L will have its right angle-shaped bore 10 communicating with the nipple 9 and with a coupling 11 that in turn communicates directly with the inlet 6 in the water pump G.

Figure 5:
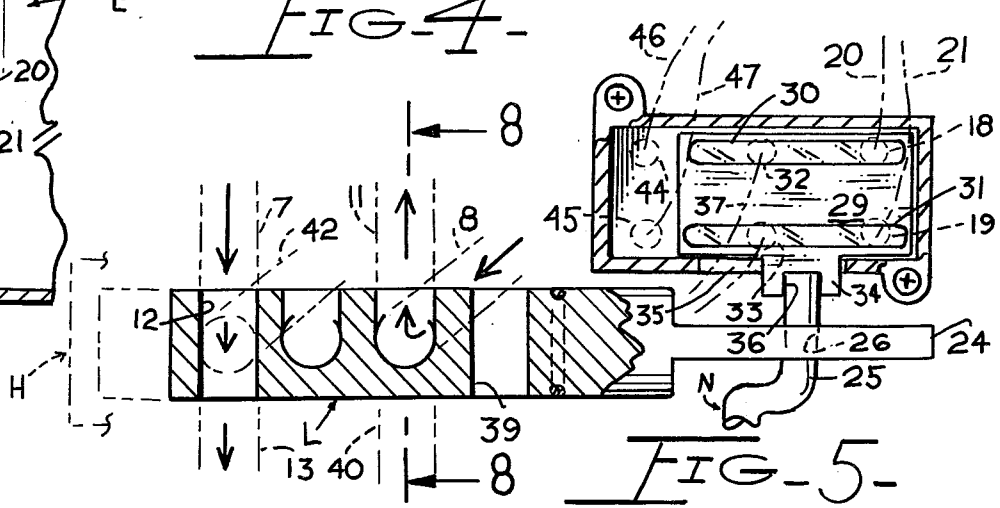
FIG. 5 is an enlarged horizontal section through the multiple water control valve body and through the multiple electric switch showing both in refill position for supplying water to the reservoir and is taken along the line 5—5 of FIG. 3.

The enlarged showing of the valve body L, in FIG. 5, shows by dotted lines the conduit 8 leading to the bore 10 and by dotted lines 11, the coupling connecting with the pump inlet 6, see also FIG. 4. The valve body L when in the "fill cycle" position will have another transversely extending bore 12 in communication with the water inlet 7 for the pump G, and with a nipple 13 that communicates directly with the reservoir E so that water will be transferred from the water source M to the reservoir. We will explain hereinafter the electrical circuit that will cause the motor F to operate the pump G to effect this transfer of water.

It will be noted from FIG. 1 that the water reservoir E, is provided with a water gage 14 which will indicate the water level in the reservoir. The water containing jug M, is preferably made transparent so that the operator can see at a glance how much water is in it. We provide a simple float 15 for opening a cut-off electric switch 16 in the reservoir E and for breaking the electric circuit to the motor F when the water level in the reservoir E reaches a certain height, see FIG. 7 with views A and B. In view A, the water level has not reached the float 15, while in view B, of FIG. 7, the float and its non-conducting stem has opened the electric switch.

We will now describe the electric circuit used when refilling the reservoir E with water from the source of water M, shown in FIG. 1. The multiple switch J, shown in FIG. 5, has a pair of contacts 18 and 19 with wires 20 and 21 leading to the emergency cut-off and float-controlled switch 16. These wires are in parallel with two other wires 22 and 23 that are connected to them and can be connected to 110v electric outlet. It will be further noted from FIG. 5 that the valve body L has an extension 24 and a valve body actuator N has a crank-shaped portion 25 that extends through a vertical slot 26 in the valve body extension 24, see FIG. 3. The valve body actuator has an elongated rod-like portion 27, see FIG. 2 that underlies the bottom of the reservoir E and the front end of the rod 27 is bent at right angles to form a handle 28 which is clearly shown in FIG. 1. This handle 28 can be rocked from "REFILL" position into "AUTO" position. We are dealing with the "REFILL" position at the present and will describe the "AUTO" position later on.

The multiple electric switch J has a non-conducting plate 29 that can be shifted from the "REFILL" position shown in FIGS. 4 and 5, into the "AUTO" position shown in FIG. 6. The plate 29 carries two conducting strips 30 and 31, or bus bars, that contact the terminals 18 and 19, respectively, and also contact terminals 32 and 33. The plate 29 has a projection 34 slidably received in a slot 35 provided in the front wall of the multiple switch casing J. This projection forms a clevis 36 that slidably receives the adjacent end of the crank-shaped portion 25 of the valve body actuator N. Therefore, when the handle 28 of the actuator N, is swung from "REFILL" position into "AUTO" position in FIG. 1, the crank portion 25 of the actuator will not only shift the valve body L to the left from that shown in FIGS. 4 and 5, into that shown in FIG. 6, but the plate 29 in the multiple switch J will be moved from the position shown in FIG. 5 into that shown in FIG. 6. But we are still concerned with the "REFILL" position of the plate 29 in FIG. 5 for the present.

We have already stated that the bus bars 30 and 31, shown in FIG. 5 contact the electric terminals 32 and 33. Wires 37 and 38 lead from the terminals 32 and 33 to the electric motor F, see FIGS. 2 to 5 inclusive. The wiring diagram of FIG. 9, shows that when the bus bars 30 and 31 electrically connect the terminals 18 and 19 to the terminals 32 and 33, respectively, the motor F will be connected to the 110v. outlet by the wires 22 and 23, and the pump G will deliver water from the water source M to the reservoir E until the float 15 opens the switch 16.

We will now describe the "AUTO" position which means automatic position and it is the normal position of our device which is designed to feed water under the required pressure to the ice maker each time it is needed. When the operator swings the handle 28 of the valve body actuator N, into the "AUTO" position shown in FIG. 1, the crank portion 25 of the actuator will move the valve body L to the left from the position shown in FIGS. 4 and 5 into that shown in FIG. 6. This will move the transversely extending bore 39 in the valve body into registration with the coupling 11 that communicates with the inlet 6 to the pump G, and the bore 39 will also register with a nipple 40 that communicates with the interior of the reservoir E. At the same time another angle-shaped bore 41 in the body L will be moved from inoperative position shown in FIG. 5, into operative position of FIG. 6 where it will connect the pump outlet 7 with a conduit 42 that leads to the solenoid valve C. From the solenoid valve another conduit 43 will connect with the ice maker B.

The same rotation of the handle 28 that moves the valve body L, into "AUTO" position will also shift the plate 29 in the multiple switch and cause the bus bar 30 to electrically connect the terminal 32 with a terminal 44 and the terminal 33 with a terminal 45, see FIGS. 4, 5 and 9. Wires 46 and 47 lead from the terminals 44 and 45 to the sequence cam actuated switch 2 and to the 110v. electrical outlet 48 that is used for operating the refrigerator A. The wires 46 and 47 are in parallel with the wires 49 and 50 in the refrigerator that are already connected to the solenoid valve C. In other words, our multiple switch J has its terminals 44 and 45 connected in such a manner to the wires in the refrigerator that when the sequence cam D rotates into a position to demand another supply of water, this cam will not only electrically open the solenoid valve C, but it will also close the switch 2 which will close a circuit from the 110v. outlet 48 to the contacts or terminals 44 and 45 and from these through the bus bars 30 and 31 to the terminals 32 and 33 and thence through the wires 37 and 38 to the motor F. This will operate the pump G, and draw water from the reservoir E through the nipple 40, valve body bore 39, see FIG. 6, thence through the pump G, and into the angled bore 41 in the valve body L. From here the water will flow under the desired pressure to the solenoid valve C which is now open and from there through the conduit 43 to the ice maker B. The sequence cam D, is timed so as to keep the switch 2 closed so long as the solenoid valve C remains open. At the end of the water filling cycle for the ice maker, the solenoid valve C will close and the switch 2 will open so as to cut off the current to the motor and stop the pump.

So long as the handle 28 remains "AUTO" position shown in FIG. 1, the mechanism is such that every time the ice maker B demands more water, the sequence cam D will function in the manner just described and will automatically close the switch 2 to feed water to the ice maker at the required water pressure.

We claim:

1. A refrigerator having an automatic ice maker unit with a first water conveying conduit communicating with said unit and having a solenoid valve for controlling the water flow through said conduit;

a. a water reservoir containing water; b. a motor driven pump that has a water inlet communicating with the water in said reservoir, said pump having a water outlet second conduit communicating with said solenoid valve; and c. said automatic ice maker having means for closing an electric circuit when the ice maker requires a supply of water, this electric circuit connecting the motor of said pump to a source of electricity for starting the motor and for opening said solenoid valve;

d. whereby when said automatic ice maker needs water and causes said means to close the electric circuit to start the motor for the pump and open said solenoid valve for feeding water under pressure from said reservoir through said pump and said water outlet second conduit through said valve and said first water conveying conduit to said automatic ice maker, the water flow continuing until said automatic ice maker unit completes its cycle and said means opens the electric circuit to the motor and will stop both the motor and the pump.

2. The combination as set forth in claim 1 and in which a. a multiple valve controls the inlet and outlet water pressure to and from said pump, the valve body normally being in a position to permit water to flow from said reservoir through said pump and into said first water conveying conduit when said automatic ice maker unit starts operating and closes the electric circuit for starting the pump motor and for opening said solenoid valve;

b. an auxilairy water source for replenishing the reservoir water;

c. a third conduit leading from said auxiliary water source to the casing for the multiple valve, said valve casing having an outlet pipe communicating with said reservoir; and d. said multiple valve having a valve body shiftable into refill position and having passages for placing said third conduit in communication with said water inlet to said pump and for placing said pump outlet in communication with said valve casing outlet pipe that communicates with said reservoir; and e. a multiple switch closing an electric circuit to said pump motor when said valve body is shifted into refill position for causing said pump to withdraw water from said auxiliary water source through said third conduit and through said multiple valve, then through said pump and again through the passage in said valve body that connects the pump outlet with said casing outlet pipe for delivering the water to the reservoir, said multiple switch being opened to stop the pump motor when said valve body is shifted from refill position into automatic position where the automatic ice maker means for closing an electric circuit becomes effective when said automatic ice maker needs water.

3. The combination as set forth in claim 2; and in which a. a common manual control operatively connects said shiftable valve body to said multiple switch whereby said manual control can actuate said valve body and said multiple switch into refill position where water will be fed from said auxiliary water source to said reservoir for refilling it and can also actuate said valve body and said multiple switch into automatic position where said ice maker when needing water will actuate said means for closing an electric circuit to the motor for operating the pump and to said solenoid valve for opening it so that the pump will draw water from said reservoir and deliver it under pressure to the automatic ice maker until the ice maker completes its cycle.

* * * * *